US010046441B2

(12) United States Patent
Bao et al.

(10) Patent No.: US 10,046,441 B2
(45) Date of Patent: Aug. 14, 2018

(54) PCD WAFER WITHOUT SUBSTRATE FOR HIGH PRESSURE / HIGH TEMPERATURE SINTERING

(71) Applicant: SMITH INTERNATIONAL, INC., Houston, TX (US)

(72) Inventors: Yahua Bao, Orem, UT (US); Ronald K. Eyre, Orem, UT (US)

(73) Assignee: SMITH INTERNATIONAL, INC., Houston, TX (US)

( * ) Notice: Subject to any disclaimer, the term of this patent is extended or adjusted under 35 U.S.C. 154(b) by 618 days.

(21) Appl. No.: 14/566,195

(22) Filed: Dec. 10, 2014

(65) Prior Publication Data

US 2015/0183092 A1 Jul. 2, 2015

Related U.S. Application Data

(60) Provisional application No. 61/922,039, filed on Dec. 30, 2013.

(51) Int. Cl.
*B24D 18/00* (2006.01)
*B24D 99/00* (2010.01)
(Continued)

(52) U.S. Cl.
CPC ..... *B24D 18/0009* (2013.01); *B24D 99/005* (2013.01); *E21B 10/55* (2013.01); *E21B 10/56* (2013.01); *E21B 10/567* (2013.01)

(58) Field of Classification Search
CPC .. B24D 18/00; B24D 3/00; C09K 3/14; E21B 10/00; E21B 10/46; E21B 10/55; E21B 10/56; E21B 10/567
See application file for complete search history.

(56) References Cited

U.S. PATENT DOCUMENTS 6,342,301 B1 1/2002 Yoshida et al.
7,261,753 B2 8/2007 Yamamoto et al.
(Continued)

FOREIGN PATENT DOCUMENTS

GB 2384260 A 7/2003
WO WO2009147629 A1 12/2009
(Continued)

OTHER PUBLICATIONS

International Search Report and Written Opinion issued in PCT/US2014/070276 dated Apr. 2, 2015, 9 pages.
(Continued)

*Primary Examiner* — Jennifer A Smith
*Assistant Examiner* — Alexandra M Moore

(57) ABSTRACT

A method of forming a cutting element may include subjecting a first press containing at least a diamond powder-containing container and a volume of a high melting temperature non-reactive material to a first high pressure high temperature sintering condition to form a sintered polycrystalline diamond wafer including a diamond matrix of diamond grains bonded together and a plurality of interstitial spaces between the bonded together diamond grains; and subjecting a second press containing the sintered polycrystalline diamond wafer and a substrate to a second high temperature high pressure condition, thereby attaching the wafer to the substrate to form a cutting element having a polycrystalline diamond layer on the substrate.

20 Claims, 3 Drawing Sheets

(51) Int. Cl.

| | |
|---|---|
| ***E21B 10/56*** | (2006.01) |
| ***E21B 10/55*** | (2006.01) |
| ***E21B 10/567*** | (2006.01) |

(56) References Cited

U.S. PATENT DOCUMENTS

| | | | | |
|---|---|---|---|---|
| 7,845,438 | B1 | 12/2010 | Vail et al. | |
| 7,866,418 | B2 | 1/2011 | Bertagnolli et al. | |
| 7,971,663 | B1 * | 7/2011 | Vail | B01J 3/062 175/428 |
| 8,002,859 | B2 | 8/2011 | Griffo et al. | |
| 8,020,645 | B2 | 9/2011 | Bertagnolli et al. | |
| 8,034,136 | B2 | 10/2011 | Sani | |
| 8,071,173 | B1 | 12/2011 | Sani | |
| 8,074,566 | B1 * | 12/2011 | Bach | B01J 3/062 100/102 |
| 8,236,074 | B1 | 8/2012 | Bertagnolli et al. | |
| 8,267,204 | B2 | 9/2012 | Lyons | |
| 8,328,891 | B2 | 12/2012 | Zhang et al. | |
| 8,353,371 | B2 | 1/2013 | Cooley et al. | |
| 8,485,284 | B2 | 7/2013 | Sithebe | |
| 8,968,436 | B2 | 3/2015 | Suryavanshi | |
| 2005/0050801 | A1 * | 3/2005 | Cho | B22F 7/008 51/293 |
| 2008/0223623 | A1 | 9/2008 | Keshavan et al. | |
| 2009/0313908 | A1 | 12/2009 | Zhang et al. | |
| 2010/0012389 | A1 | 1/2010 | Zhang et al. | |
| 2010/0281782 | A1 | 5/2010 | Keshavan et al. | |
| 2010/0181117 | A1 | 7/2010 | Scott | |
| 2011/0030283 | A1 | 2/2011 | Cariveau et al. | |
| 2011/0036641 | A1 | 2/2011 | Lyons | |
| 2011/0083909 | A1 | 4/2011 | Shen et al. | |
| 2011/0120782 | A1 | 5/2011 | Cooley et al. | |
| 2011/0192652 | A1 | 8/2011 | Shen et al. | |
| 2011/0232200 | A1 | 9/2011 | Griffo et al. | |
| 2011/0258936 | A1 | 10/2011 | Digiovanni | |
| 2011/0266059 | A1 | 11/2011 | DiGiovanni et al. | |
| 2012/0040183 | A1 | 2/2012 | Kelkar | |
| 2012/0097457 | A1 | 4/2012 | Setlur et al. | |
| 2012/0111642 | A1 | 5/2012 | DiGiovanni | |
| 2012/0138370 | A1 | 6/2012 | Mukhopadhyay et al. | |
| 2012/0222363 | A1 | 9/2012 | DiGiovanni et al. | |
| 2012/0222364 | A1 | 9/2012 | Lyons et al. | |
| 2012/0225253 | A1 | 9/2012 | DiGiovanni et al. | |
| 2012/0225277 | A1 | 9/2012 | Scott | |
| 2012/0241224 | A1 | 9/2012 | Qian et al. | |
| 2013/0015000 | A1 | 1/2013 | Zhang et al. | |
| 2013/0067824 | A1 | 3/2013 | King et al. | |
| 2013/0074420 | A1 | 3/2013 | Zhang et al. | |
| 2013/0092451 | A1 | 4/2013 | Mukhopadhyay et al. | |
| 2013/0092452 | A1 | 4/2013 | Mukhopadhyay et al. | |
| 2013/0168159 | A1 | 7/2013 | Eyre et al. | |

FOREIGN PATENT DOCUMENTS

| | | | |
|---|---|---|---|
| WO | WO2010045257 | A1 | 4/2010 |
| WO | WO2010084447 | A1 | 7/2010 |
| WO | WO2010100629 | A2 | 9/2010 |
| WO | WO2011141898 | A1 | 11/2011 |
| WO | WO2012010646 | A2 | 1/2012 |
| WO | 20125128948 | A1 | 9/2012 |

OTHER PUBLICATIONS

International Preliminary Report on Patentability issued in International Patent application PCT/US2014/070276, dated Jul. 14, 2016. 6 pages.

First Office Action and Search Report issued in Chinese Patent Application 201480075229.X dated Mar. 17, 2017. 11 pages.

* cited by examiner

PCD WAFER WITHOUT SUBSTRATE FOR HIGH PRESSURE / HIGH TEMPERATURE SINTERING

CROSS-REFERENCE TO RELATED APPLICATION

This application claims the benefit of U.S. Provisional Application No. 61/922039, filed 30 Dec. 2013.

BACKGROUND

Polycrystalline diamond compact ("PDC") cutters have been used in industrial applications including rock drilling and metal machining for many years. Generally, a compact of polycrystalline diamond ("PCD") or other superhard material is bonded to a substrate material, e.g., a sintered metal-carbide, such as cemented tungsten carbide, to form a cutting structure. PCD comprises a polycrystalline mass of diamonds that are bonded together to form an integral, tough, high-strength mass or lattice. The resulting PCD structure produces enhanced properties of wear resistance and hardness, making PCD materials extremely useful in aggressive wear and cutting applications where high levels of wear resistance and hardness are desired. For use in the oil industry, PCD cutting elements are provided in the form of specially designed cutting elements such as PCD wafers that are configured for attachment with a subterranean drilling device.

A PDC cutter may be formed by placing a cemented carbide substrate into the container of a press. A mixture of diamond grains or diamond powder and catalyst binder is placed atop the substrate and treated under high pressure high temperature (HPHT) conditions. In doing so, metal binder (often cobalt) migrates from the substrate and passes through the diamond grains to promote intergrowth between the diamond grains. As a result, the diamond grains become bonded to each other to form the diamond layer, and the diamond layer is in turn bonded to the substrate. The substrate often includes a metal-carbide composite material, such as tungsten carbide. The deposited diamond layer is often referred to as the "diamond table" or "abrasive layer." The term "particle" refers to the powder employed prior to sintering a superabrasive material, while the term "grain" refers to discernable superabrasive regions subsequent to sintering.

Generally, PCD may include from 85 to 95% by volume diamond and a balance of the binder material, which is present in PCD within the interstices existing between the bonded diamond grains. Binder materials used for forming conventional PCD include metals from Group VIII of the Periodic table, such as cobalt, iron, or nickel and/or mixtures or alloys thereof, with cobalt being the most common binder material used. However, while higher metal content increases the toughness of the resulting PCD material, higher metal content also decreases the PCD material hardness, thus limiting the flexibility of being able to provide PCD coatings having desired levels of both hardness and toughness. Additionally, when variables are selected to increase the hardness of the PCD material, brittleness also increases, thereby reducing the toughness of the PCD material.

FIG. 1 schematically illustrates a microstructure of a conventional PCD material 100. As illustrated, PCD material 100 includes a plurality of diamond grains 120 that are bonded to one another to form an intercrystalline diamond matrix first phase. The catalyst/binder material 140, e.g., cobalt, used to facilitate the diamond-to-diamond bonding that develops during the sintering process, is dispersed within the interstitial regions formed between the diamond matrix first phase. Particularly, as shown in FIG. 1, the binder material 140 is not continuous throughout the microstructure in the PCD material 100. Rather, the microstructure of the PCD material 100 may have a uniform distribution of binder among the PCD grains. Thus, crack propagation through conventional PCD material will often travel through the less ductile and brittle diamond grains, either transgranularly through diamond grain/binder interfaces 150, or intergranularly through the diamond grain/diamond grain interfaces 160.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments of the present disclosure relate to a method of forming a cutting element that includes subjecting a first press containing at least a diamond powder-containing container and a volume of a high melting temperature non-reactive material to a first high pressure high temperature sintering condition to form a sintered polycrystalline diamond wafer including a diamond matrix of diamond grains bonded together and a plurality of interstitial spaces between the bonded together diamond grains; and subjecting a second press containing the sintered polycrystalline diamond wafer and a substrate to a second high temperature high pressure condition, thereby attaching the wafer to the substrate to form a cutting element having a polycrystalline diamond layer on the substrate.

In another aspect, embodiments disclosed herein relate to a method of forming a cutting element that includes placing in a refractory metal container, a first assembly including a volume of diamond powder adjacent a layer of a catalyst material (e.g., a distinct layer of a catalyst material); assembling the refractory metal container containing the first assembly with a volume of a high melting temperature non-reactive material adjacent the refractory metal container to form a second assembly; subjecting the second assembly to a first high pressure high temperature sintering condition to form a sintered polycrystalline diamond wafer including a diamond matrix of diamond grains bonded together and a plurality of interstitial spaces between the bonded together diamond grains that includes the catalyst material; subjecting the sintered polycrystalline diamond wafer to a first leaching process causing the catalyst material to be substantially removed from the polycrystalline diamond wafer to form a leached polycrystalline diamond wafer substantially free of the catalyst material; and subjecting the leached polycrystalline diamond wafer and a substrate to a second high temperature high pressure condition for attachment of the wafer to the substrate to form a cutting element having a polycrystalline diamond layer on the substrate.

Other aspects and advantages of the claimed subject matter will be apparent from the following description and the appended claims.

BRIEF DESCRIPTION OF DRAWINGS

Embodiments of the present disclosure are described with reference to the following figures. The same numbers are used throughout the figures to reference like features and components.

DETAILED DESCRIPTION

Figure 1:
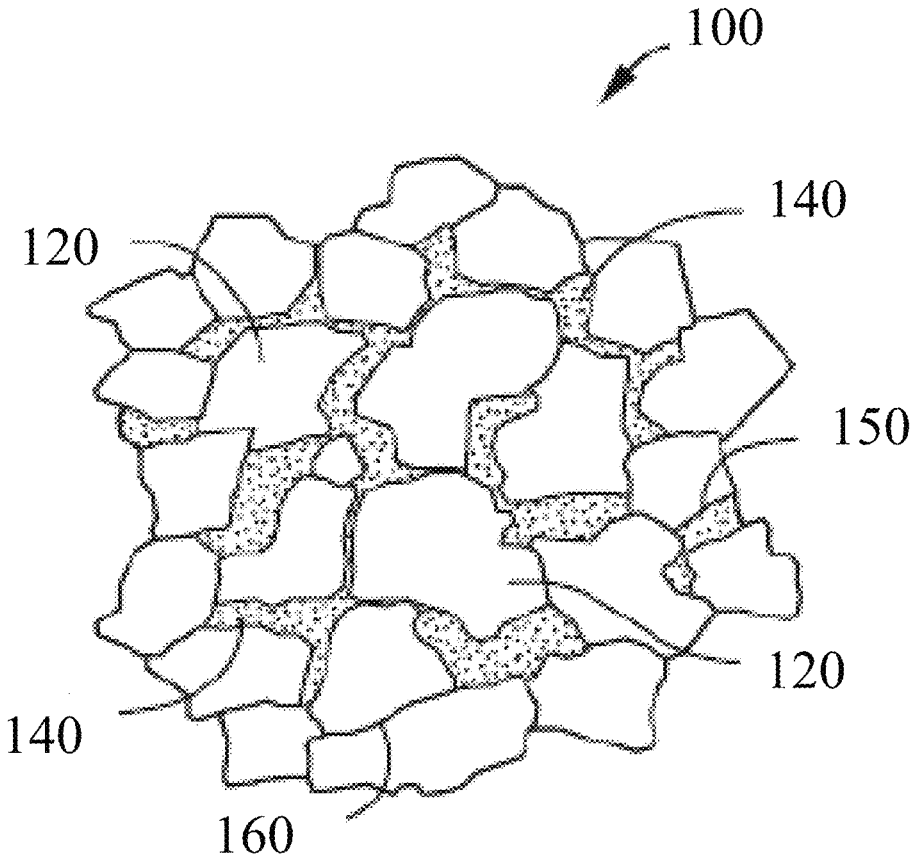
FIG. 1 Prior Art
FIG. 1 shows the microstructure of a conventionally formed polycrystalline diamond.

Generally, embodiments disclosed herein relate to polycrystalline diamond ("PCD") wafers (or bodies) and specifically, to methods of manufacturing PCD wafers without a substrate positioned for attachment to the PCD wafer during the HPHT sintering process. Thus, methods of the present disclosure may relate to the formation of PCD wafers from diamond powder during a HPHT sintering condition in the presence of a high melting temperature non-reactive material, such as a strong back material, and optionally a catalyst material. As discussed herein, the resulting PCD wafer may optionally be subjected to one or more additional processing steps, such as leaching to remove catalyst material and/or a second HPHT sintering condition for attachment of the wafer to a substrate.

In one or more embodiments, a polycrystalline diamond wafer or body may be formed from an assembly including diamond powder and a catalyst material disposed adjacent to a high melting temperature non-reactive material. The polycrystalline diamond body may be formed in a conventional manner, such as by a high pressure, high temperature sintering of "green" particles to create intercrystalline bonding between the particles, but with the inclusion of the high melting temperature non-reactive material. Briefly, to form the polycrystalline diamond wafer, an unsintered mass of diamond crystalline particles is placed within a metal enclosure of the reaction cell of an HPHT apparatus. A metal catalyst, such as cobalt or other Group VIII metals, including cobalt, nickel, or iron, may be included with the unsintered mass of crystalline particles to promote intercrystalline diamond-to-diamond bonding. However, it is also within the scope of the present disclosure that other catalyst materials may be used alone or in combination. The catalyst material may be provided in the form of powder and mixed with the diamond grains, or may be infiltrated into the diamond grains during HPHT sintering, such as from a distinct layer of catalyst material. Subjecting the assembly to HPHT conditions may cause intercrystalline bonding to occur between adjacent diamond crystals to form a network or matrix phase of diamond-to-diamond bonding and a plurality of interstitial regions dispersed between the bonded together diamond grains. HPHT sintering conditions that may be used to form polycrystalline diamond from diamond powder in the presence of a solvent catalyst material that functions to facilitate the bonding together of the diamond grains may include temperatures between about 1,350 to 2000° C. and pressures of 5,000 MPa or higher.

As used herein, the term "refractory metal container" is a pressure transmitting medium which is subjected to an HPHT process. The refractory metal container acts as a barrier between the container contents (diamond powder) and any material outside of the container, so there is no reaction between diamond and the material outside of the container during the HPHT process.

Diamond grains useful for forming a polycrystalline diamond body may include any type of diamond particle, including natural or synthetic diamond powders having a wide range of grain sizes. For example, such diamond powders may have an average grain size in the range from submicrometer to 100 micrometers, or from 1 to 80 micrometers in other embodiments. Further, the diamond powder may include grains having a mono- or multi-modal distribution.

In another embodiment, the diamond powder mixture can be provided in the form of a green-state part or mixture including diamond powder that is contained by a binding agent, e.g., in the form of diamond tape or other formable/confirmable diamond mixture product to facilitate the manufacturing process. In the event that the diamond powder is provided in the form of such a green-state part, it is desirable that a preheating treatment take place before HPHT consolidation and sintering to drive off the binder material. In an example embodiment, the PCD body resulting from the above-described HPHT process may have a diamond volume content in the range of from about 85 to 95 percent. For certain applications, a higher diamond volume content up to about 98 percent may be desired.

During this HPHT process, the catalyst material in the mixture melts and infiltrates the diamond grain powder to facilitate intercrystalline diamond bonding. During the formation of such intercrystalline diamond bonding, the catalyst material may migrate into the interstitial regions within the microstructure of the so-formed PCD body that exists between the diamond bonded grains. It should be noted that if too much additional non-diamond material is present in the powdered mass of crystalline particles, appreciable intercrystalline bonding may be prevented during the sintering process. Such a sintered material where appreciable intercrystalline bonding has not occurred is not within the definition of PCD. Following such formation of intercrystalline bonding, a polycrystalline diamond body may be formed that has, in one embodiment, at least about 80 percent by volume diamond, with the remaining balance of the interstitial regions between the diamond grains occupied by the catalyst material. In other embodiments, such diamond content may have at least 85 percent by volume of the formed diamond body, or at least 90 percent by volume in yet another embodiment. However, one skilled in the art would appreciate that other diamond densities may be used in alternative embodiments. Thus, the polycrystalline diamond bodies being used in accordance with the present disclosure include what is frequently referred to in the art as "high density" polycrystalline diamond.

Figure 2:
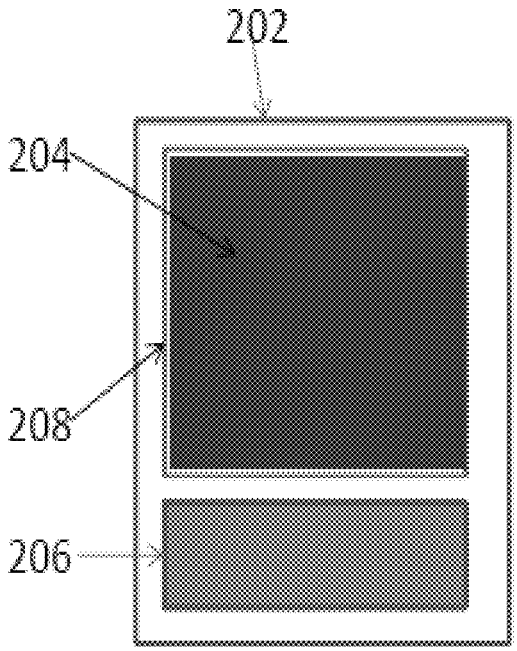
FIGS. 2 and 3 show a diagram for forming polycrystalline diamond bodies according to embodiments of the present disclosure.

As mentioned above, in addition to the diamond powder and catalyst material, the PCD constructions of this disclosure may also be formed in the presence of a high melting temperature non-reactive material. FIG. 2 schematically illustrates an example of an assembly of components for making the PCD materials of the present disclosure. As shown, a diamond powder 204 is placed in a metal reaction container 208. In addition, container 208 (e.g., a refractory metal container containing diamond powder 204, and in one embodiment consisting of diamond powder 204 and an optional catalyst material) is assembled with a high melting temperature non-reactive material 206. In this illustrated embodiment, high melting temperature non-reactive material 206 is placed outside of and adjacent to the container 208; however, other embodiments may involve placement of the high melting temperature non-reactive material 206 within container 208. In some embodiments, the container 208 may consist essentially of diamond powder 204 and catalyst material, and the container 208 does not include a substrate material such as WC or WC-Co. The assembly of container 208 and the high melting temperature non-reactive material 206 is placed in a resistive heating tube 202, which is subjected to HPHT sintering conditions. While not specifically illustrated, it is within the scope of the present disclosure that the resistive heating tube 202 may include a plurality of containers 208 (containing diamond powder 204) loaded therein. Further, depending on the number of containers 208 incorporated into the resistive heating tube 202, it may also be desirable to use a plurality of high melting temperature non-reactive materials 206. Upon subjecting the diamond powder 204 to HPHT sintering conditions, the plurality of diamond particles are bonded together to form a sintered PCD wafer. Further, because the diamond powder is provided in the reaction container without a substrate or substrate material, the PCD wafer formed is a free-standing body without a substrate bonded thereto.

In the illustrated embodiment, the PCD wafer is formed by using a high melting temperature non-reactive material, more specifically a strong back material. As used herein, the term "strong back material" is understood to be those materials that are capable of acting as a filler of the press during a HPHT sintering condition, thus, maximizing the green state of the powder. As used herein, a strong back material is placed outside of the reaction container. A high melting temperature non-reactive material may generally include strong back materials as well as other materials that would not react with or bond to the PCD wafer, and which may therefore be assembled either within or outside of the container. Generally, while it would be desirable to place a maximum number of reaction containers (containing diamond powder) in a press to maximize the number of PCD wafers formed during a single press cycle, doing so would result in a pressure reduction within the press due to the contraction of the materials during the HPHT sintering conditions. Thus, by incorporating a non-compressible "filler" in the press, high internal cell pressures may still be achieved. As such, the addition of the high melting temperature non-reactive material, such as a strongback material, in the press may result in an increase in the internal cell pressure in the range of 1% to 20%, as compared to a press in which no high melting temperature non-reactive material is used.

Thus, a high melting temperature non-reactive material or strong back material may exhibit one or more of the following properties: 1) is a high melting temperature non-reactive material; 2) has a melting temperature that is above the temperature used in the HPHT sintering process; 3) is less compressible than other materials; 4) does not react during the HPHT sintering process; 5) substantially maintains its original volume in the press container; and 6) has an elastic modulus of over 400 $kN/mm^2$ and a bulk density of over 90%. Strong back materials belong to the family of carbides, nitrides, carbonitrides, ceramic materials, metallic materials, cermet materials including a noncatalyzing material such as WC—Cu, WC—Cu alloy, or the like, including other materials with an elastic modulus of over 400 $kN/mm^2$ and a bulk density of over 90%, but it is also intended that other materials that do not promote the change or interaction of the diamond particles at temperatures below about 2,200° C. may be used within the reaction container as a high melting temperature non-reactive material. Depending on the type of a high melting temperature non-reactive material or strong back material selected, the strong back material may be placed outside of, but adjacent to, the container in which the diamond powder is placed, so that the strong back material is prevented from reacting with the diamond. It is also within the scope of the present disclosure that there is no limitation of the placement of the strong back material in the press, relative to the reaction container. Thus, combinations such as container-strong back-container or strong back-container-container-strong back, or any other variation are possible.

Advantageously, the inventors of the present disclosure have found a way to maximize the pressure cell during the sintering process by using a high melting temperature non-reactive material, in some embodiments, a strong back material, that is placed outside the reaction container to prevent it from reacting with the diamond powder. The inclusion of such a material within the press may reduce and/or minimize the amount of the internal cell pressure reduction during the sintering process due to a reduction in the diamond volume. As such, with equivalent hydraulic pressures, the internal cell pressure when including a strong back or other high melting temperature non-reactive material may vary by 0.1-0.5 GPa, and the internal cell pressure without a high melting temperature non-reactive material may vary by 0.5-1.0 GPa, depending on the ratio of diamond powder volume and strong back volume. Thus the total variance of internal cell pressures with and without a strong-back material may range from 0.1 to 1.0 GPa.

Figure 3:
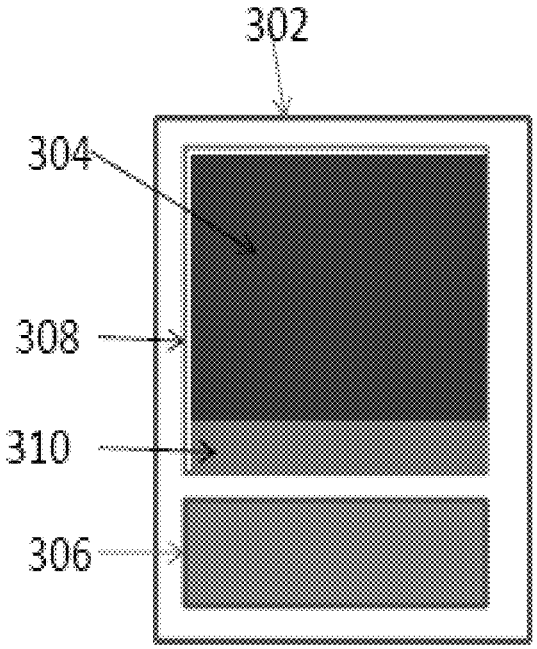

According to some embodiments, a catalyst material may be placed as a distinct layer, separate from, and not pre-mixed with, the diamond mixture in the refractory metal container. For example, referring now to FIG. 3, a diamond powder 304 may be placed in a metal reaction container 308. In addition, also assembled with the diamond powder 304 in the container 308 is a distinct layer of catalyst material 310. The container 308 (containing diamond powder 304 and catalyst material 310, and in one embodiment, consisting of diamond powder 304 and catalyst material 310) is assembled with a high melting temperature non-reactive material 306. In this illustrated embodiment, high melting temperature non-reactive material 306 is placed outside of and adjacent to the container 308; however, other embodiments may involve placement of the high melting temperature non-reactive material 306 within container 308. The assembly of container 308 and high melting temperature non-reactive material 306 is placed in a resistive heating tube 302, which is subjected to HPHT sintering conditions. While not specifically illustrated, it is specifically within the scope of the present disclosure that the resistive heating tube 302 may include a plurality of containers 308 (containing diamond powder 304 and catalyst material 310) loaded therein. Further, depending on the number of containers 308 incorporated into the resistive heating tube 302, it may also be desirable to use a plurality of high melting temperature non-reactive materials 306. Upon subjecting the diamond powder 304 and catalyst material 310 to HPHT sintering conditions, the catalyst material 310 melts and infiltrates through the diamond particles, catalyzing intercrystalline bonding between diamond grains to form a sintered PCD wafer. Further, because the diamond powder is provided in the reaction container without a substrate or substrate material, the PCD wafer formed is a free-standing body without a substrate bonded thereto. The catalyst material may be provided in the form of a metal foil or metal disc. Other embodiments include the catalyst material provided as a mixture with tungsten and/or tungsten carbide powders. In various embodiments, the catalyst material may have a weight percentage of the pre-mix material of 10-100%.

Further, after formation of a PCD wafer in accordance with the above described methods, the PCD wafer may optionally be subjected to one or more additional processes. For example, the formed PCD wafer may be subsequently attached to a substrate, such as by a second high pressure high temperature process. Depending on the attachment route, it may also be desirable to remove catalyst material from the PCD wafer prior to HPHT sintering. In one or more other embodiments, at least partial removal of the catalyst material may be performed without subsequently attaching the PCD wafer to a substrate.

In an example embodiment, the catalyst material is removed from the PCD body by a suitable process, such as by chemical treatment such as by acid leaching or aqua regia bath, electrochemically such as by an electrolytic process, by a liquid metal solubility technique, by a liquid metal infiltration technique that sweeps the existing second phase material away and replaces it with another during a liquid-phase sintering process, or by combinations thereof. As used herein, the term "removed" is used to refer to the reduced presence of the solvent metal catalyst material in the PCD wafer, and is understood to mean that a substantial portion of the solvent metal catalyst material no longer resides within the PCD wafer. However, it is to be understood that some small trace amounts of the solvent metal catalyst material may still remain in the microstructure of the PCD wafer within the interstitial regions and/or adhered to the surface of the diamond crystals. Additionally, the term "substantially free", as used herein to refer to the remaining PCD wafer after the solvent metal catalyst material has been removed, is understood to mean that there may still be some trace small amounts of the solvent metal catalyst remaining within the PCD body as noted above.

In an example embodiment, the solvent metal catalyst material is removed from the entire or a desired region of the PCD body by an acid leaching technique. Suitable acids include nitric acid, hydrofluoric acid, hydrochloric acid, sulfuric acid, phosphoric acid, perchloric acid, or combinations of these acids. In addition, caustics, such as sodium hydroxide and potassium hydroxide, have been used by the carbide industry to digest metallic elements from carbide composites. In addition, other acidic and basic leaching agents may be used as desired. Those having ordinary skill in the art will appreciate that the molarity of the leaching agent may be adjusted depending on the time desired to leach, concerns about hazards, etc.

The quantity of the catalyst material remaining in the material microstructure after the PCD body has been subjected to a leaching treatment will vary on such factors as the efficiency of the removal process, the size and density of the diamond matrix material, or the desired amount of any solvent catalyst material to be retained within the PCD body. For example, it may be desired in certain applications to permit a small amount of the solvent metal catalyst material to stay in the PCD body. In an example embodiment, it may desired that the PCD body includes no greater than about 1 percent by volume of the solvent metal catalyst material. Further, one skilled in the art would appreciate that it may be acceptable or desired in certain applications to allow a small amount of catalyst material to stay in the PCD body. In a particular embodiment, the PCD body may include up to 1-2 percent by weight of the catalyst material.

By leaching out the catalyst (e.g., cobalt), thermally stable polycrystalline (TSP) diamond may be formed. In certain embodiments, a select portion of a diamond composite is leached, in order to gain thermal stability without losing impact resistance. As used herein, the term TSP includes both of the above (i.e., partially and completely leached) compounds. Interstitial volumes remaining after leaching may be reduced by either furthering consolidation or by filling the volume with a secondary material. Leaching of polycrystalline diamond body removes at least a substantial portion of the catalyzing material from the interstitial regions, leaving a polycrystalline diamond body having voids therein. Further, the leached PCD wafer may then be attached to a substrate through HPHT sintering, to facilitate attachment to a bit, cutting tool, or other end use, for example. When the leached PCD wafer is attached to a substrate through an HPHT process, one or more embodiments may involve removal of substantially all catalyst material throughout the entire PCD wafer.

While traditional PCD catalysts, such as Group VIII solvent catalysts including cobalt, may be used to form the PCD, other catalysts may be used. For example, carbonate catalysts, such as magnesium carbonate, may be used. Such catalysts may be leached (e.g., decomposed) via known leaching methods.

During a second HPHT process in which a preformed wafer is bonded to a substrate, an infiltrant material provided from the substrate may be liquefied and may infiltrate into the PCD wafer into the interstitial regions between previously bonded together diamond grains that contained the catalyst material prior to its removal from the PCD wafer. During this infiltration and subsequent cool down, the PCD wafer becomes bonded to the substrate, thereby forming a cutting element having a polycrystalline diamond layer attached to the substrate. Further, depending on the end use of the cutting element (and temperatures expected) and the type of infiltrant used, it may also be desirable to remove at least a portion of the infiltrant material from the interstitial regions of the polycrystalline diamond layer, such as by using the above described techniques. In such a process, it is noted that the infiltrant may desirably be removed from a given depth from the working (upper and side) surfaces of the PCD layer, such as at least 50 microns, and up to 1 mm or more, depending on material properties desired, cutting element size, etc.

In an example embodiment, the device is controlled so that the container is subjected to an HPHT process including a pressure in the range of from 5 to 7 GPa and a temperature in the range of from about 1320 to 2000° C., for a sufficient period of time. In some embodiments, the pressure of the second HPHT process may be greater than that of the first HPHT process and in other embodiments, the pressure of the second HPHT process may be less than that of the first HPHT process. While a particular pressure and temperature range for this second HPHT process has been provided, it is to be understood that such processing conditions can and will vary depending on such factors as the type and/or amount of infiltrant material used in the substrate. After the HPHT process is completed, the container is removed from the HPHT device, and the assembly including the bonded together PCD body and substrate is removed from the container.

In an example embodiment, the substrate used to form the PCD compact is formed from a cermet material such as WC—Co that contains the infiltrant material used to fill the PCD body. Suitable materials for the substrate include, without limitation, metals, ceramics, and or cemented carbides. Suitable infiltrant materials include Group VIII metals of the Periodic table or alloys thereof, including iron, nickel cobalt, or alloys thereof. The attachment or (reattachment) of the PCD body to a substrate may be achieved by placing the two pieces together in a refractory metal can and subjecting the two to sintering conditions to join the two bodies together.

Conventional PCD wafer formed by sintering polycrystalline diamond on carbide substrates, followed by removal of the substrate, leaching of the catalyst and reattachment of the substrate are limited by the residual stresses. However, the inventors of the present disclosure have found that PCD wafer sintering without carbide substrates may save manufacturing costs and manage residual stresses and material flatness. Advantageously, the inventors of the present disclosure have found that a non-compressive high melting temperature non-reactive material used as a filler of the press cell maximizes or increases the internal pressure in the cell. According to some embodiments of the present disclosure, placing a strong back material outside of and adjacent to conventional refractory metal containers (containing diamond particles and a catalyst used in the HPHT sintering process) may allow for high pressures to be achieved within the container and press generally. Furthermore, multiple containers of diamond powder may be assembled with one or more volumes of strong back material into a single press cell. The individual container assemblies may be stacked together with a high temperature non-reactive material between them into graphite heater tubes. Since there are no carbide substrates in the first sintering process, a greater total volume of diamond can be included for HPHT sintering, without experiencing reduction in internal cell pressures due to diamond volume reduction. Conventionally, due to the chamber size limitation, a limited number of parts can be loaded into the HPHT cell. Thus, the use of the strong back material or other high temperature non-reactive material allows for more parts to be loaded into the HPHT apparatus for sintering, which in turns lowers manufacturing cost and increases production volume. In addition, finishing time can also be shortened due to less lapping time, without carbide and with flatter surfaces. Depending on the powder premix in the diamond mix or infiltration source, the wafers can also be leached as much as two times faster prior to the re-bonding stage.

Further, in one or more embodiments, in which PCD wafers are formed from a catalyst material provided as a foil or a disc and the cell pressure is maintained by the addition of a strong back material or other high temperature non-reactive material as a filler, the PDC wafers display marked improvements in thermal stability, and thus service life, when compared to conventional PCD materials that include the catalyst material mixed into the powder. PCD wafers of this disclosure can be used to form wear and/or cutting elements in a number of different applications such as downhole or other cutting tools. For example, PCD wafers of the present disclosure may be particularly well suited for use as wear and/or cutting elements that are used in the oil and gas industry in such application as on drill bits used for drilling subterranean formations.

Figure 4:
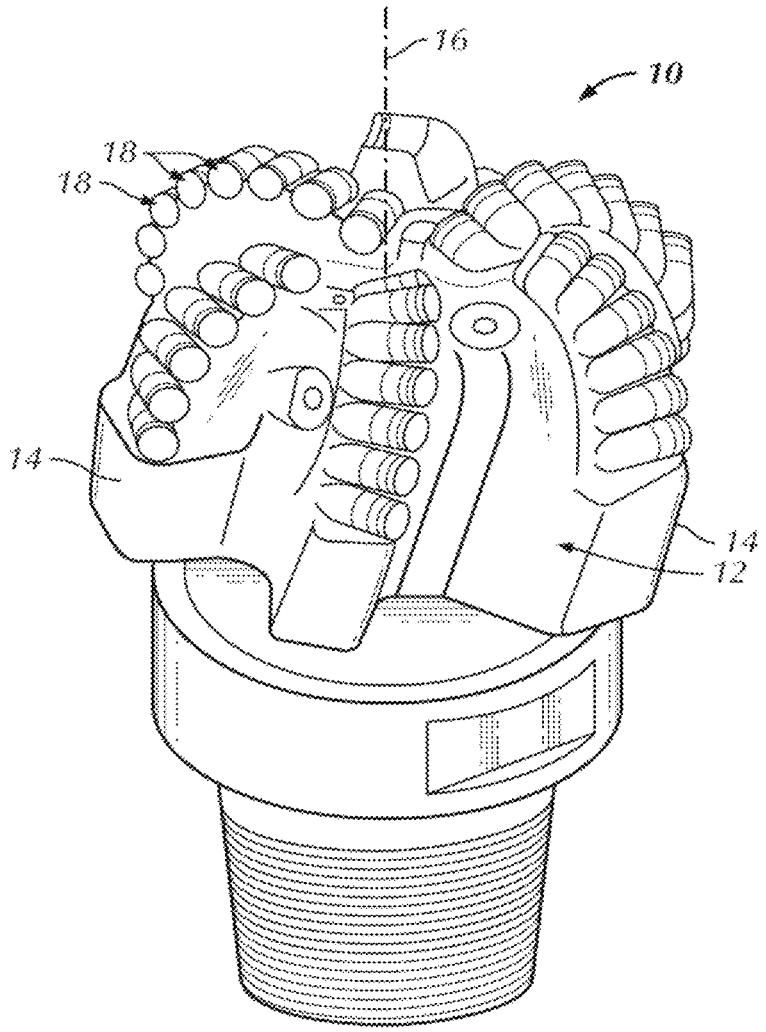
FIG. 4 shows a PDC drill bit.

For example, FIG. 4 shows a rotary drill bit 10 having a bit body 12. The face of the bit body 12 is formed with a plurality of blades 14, which extend generally outwardly away from a central longitudinal axis of rotation 16 of the drill bit 10. A plurality of PDC cutters 18 are disposed side by side along the length of each blade such that a working surface of the cutter 18, i.e., a surface that contacts and cuts the formation being drilled, is positioned at a leading face of the blade 14 and faces in the direction of the drill bit's rotation. In one or more embodiments, the PDC cutters may be formed using the methods disclosed herein.

Although only a few example embodiments have been described in detail above, those skilled in the art will readily appreciate that many modifications are possible in the example embodiments without materially departing from this disclosure. Accordingly, all such modifications are intended to be included within the scope of this disclosure. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed:

1. A method of forming a cutting element, comprising:

subjecting a first press containing at least a diamond powder-containing container and a volume of a high melting temperature non-reactive material positioned outside of the diamond powder-containing container to a first high pressure high temperature sintering condition to form a sintered polycrystalline diamond wafer comprising a diamond matrix of diamond grains bonded together and a plurality of interstitial spaces between the bonded together diamond grains;

wherein the high melting temperature non-reactive material has a melting temperature above the temperature used in the first high pressure high temperature sintering condition; and subjecting a second press containing the sintered polycrystalline diamond wafer and a substrate to a second high temperature high pressure condition, thereby attaching the wafer to the substrate to form a cutting element having a polycrystalline diamond layer on the substrate.

2. The method as recited in claim 1, wherein during subjecting the second press to a second high temperature high pressure condition, the attachment of the wafer to the substrate results in an infiltrant material provided from the substrate infiltrating into the interstitial spaces in the polycrystalline diamond wafer.

3. The method of claim 2, further comprising treating the cutting element to remove at least a portion of the infiltrant material residing in the interstitial spaces in the polycrystalline diamond layer.

4. The method of claim 1, wherein the high melting temperature non-reactive material is a strong back material, the strong back material being a material having an elastic modulus of over 400 $kN/mm^2$ and a bulk density of over 90 percent.

5. The method of claim 4, wherein the strong back material is disposed outside and adjacent to the diamond powder-containing container.

6. The method of claim 4, wherein the strong back material is a transition metal carbide material.

7. The method of claim 1, wherein the first press comprises a plurality of the diamond powder-containing containers loaded therein, wherein the volume of the high melting temperature non-reactive material is positioned outside each of the diamond powder-containing containers.

8. The method of claim 1, wherein the pressure of the second high pressure high temperature condition is higher than that of the first high pressure high temperature condition.

9. The method of claim 1, wherein first high pressure high temperature sintering condition and the second high pressure high temperature sintering condition include temperatures up to 2000° C. and pressures up to 8 GPa.

10. A method of forming a cutting element, comprising:

placing in a refractory metal container, a first assembly comprising a volume of diamond powder adjacent a distinct layer of a catalyst material;

assembling the refractory metal container containing the first assembly and a volume of a high melting temperature non-reactive material to form a second assembly, wherein the high melting temperature non-reactive material is a material that does not change the interaction of the diamond powder at temperatures below about 2,200 degrees Celsius;

subjecting the second assembly to a first high pressure high temperature sintering condition to form a sintered polycrystalline diamond wafer comprising a diamond matrix of diamond grains bonded together and a plurality of interstitial spaces between the bonded together diamond grains that includes the catalyst material;

subjecting the sintered polycrystalline diamond wafer to a first leaching process causing the catalyst material to be substantially removed from the polycrystalline diamond wafer therefrom to form a leached polycrystalline diamond wafer substantially free of the catalyst material; and subjecting the leached polycrystalline diamond wafer and a substrate to a second high temperature high pressure condition for attachment of the wafer to the substrate to form a cutting element having a polycrystalline diamond layer on the substrate.

11. The method as recited in claim 10, wherein during attachment of the wafer to the substrate, an infiltrant material provided from the substrate infiltrates into the interstitial spaces in the polycrystalline diamond wafer.

12. The method of claim 11, wherein the cutting element is subjected to a second leaching process to remove at least a portion of the infiltrant material from the interstitial spaces in the polycrystalline diamond layer.

13. The method of claim 10, wherein the catalyst material is provided in the form of a metal foil or metal disc.

14. The method of claim 10, wherein the catalyst material is a Group VIII metal.

15. The method of claim 10, wherein the first high pressure high temperature sintering condition is sufficient to cause the catalyst material to melt and infiltrate into the volume of the diamond powder.

16. The method of claim 10, wherein the pressure of the second high pressure high temperature condition is higher than that of the first high pressure high temperature condition.

17. The method of claim 10, wherein first high pressure high temperature sintering condition and the second high pressure high temperature sintering condition include temperatures up to 2000° C. and pressures up to 8 GPa.

18. The method of claim 10, wherein the high temperature non-reactive material is a strong back material, the strong back material being a material having an elastic modulus of over 400 $kN/mm^2$ and a bulk density of over 90 percent.

19. The method of claim 18, wherein the strong back material is a transition metal carbide material.

20. A method of forming a cutting element, comprising:

assembling a volume of diamond powder and a volume of a high melting temperature non-reactive material in a container; and subjecting a first press containing the assembled container to a first high pressure high temperature sintering condition to form a sintered polycrystalline diamond wafer comprising a diamond matrix of diamond grains bonded together and a plurality of interstitial spaces between the bonded together diamond grains;

wherein the volume of the high melting temperature non-reactive material remains unbonded to the diamond grains during the first high pressure high temperature sintering condition.

* * * * *